US009970150B2

(12) United States Patent
Singleton

(10) Patent No.: US 9,970,150 B2
(45) Date of Patent: May 15, 2018

(54) TIE STEAMING DEVICE

(71) Applicant: James Singleton, Rosedale, NY (US)

(72) Inventor: James Singleton, Rosedale, NY (US)

( * ) Notice: Subject to any disclaimer, the term of this patent is extended or adjusted under 35 U.S.C. 154(b) by 52 days.

(21) Appl. No.: 14/987,262

(22) Filed: Jan. 4, 2016

(65) Prior Publication Data

US 2017/0191217 A1 Jul. 6, 2017

(51) Int. Cl.
*D06F 73/00* (2006.01)
*D06F 87/00* (2006.01)

(52) U.S. Cl.
CPC ..... *D06F 87/00* (2013.01); *D06F 73/00* (2013.01)

(58) Field of Classification Search
CPC ..... D06F 73/00; D06F 81/08; D06F 81/12; D06F 43/002; D06F 75/12; D06F 75/14; D06F 75/18; D06F 75/20; D06F 59/02; D06F 87/00; D06B 19/0029; A47G 25/76; A47G 25/78
USPC ..... 68/5 R, 5 A, 6, 222; 223/73, 82
See application file for complete search history.

(56) References Cited

U.S. PATENT DOCUMENTS 1,789,424 A 1/1931 Betke
1,977,443 A 11/1931 Lake
2,160,769 A * 5/1939 Weisberger ..... A47G 25/78 223/82
2,434,136 A * 1/1948 Wolcott ..... D06F 5/12 38/77.6
2,446,412 A 8/1948 Emmanuel
2,493,252 A 1/1950 Langley
2,637,597 A * 5/1953 Richterkessing ..... B05B 1/3033 239/488
3,060,603 A 10/1962 Blanchard et al.
3,170,257 A * 2/1965 Dziadulonis ..... A43D 95/02 12/103
3,436,852 A * 4/1969 Stansbury ..... D06F 75/12 38/77.6
5,832,639 A * 11/1998 Muncan ..... F22B 1/285 237/67
2007/0102414 A1* 5/2007 Jiang ..... D06F 75/10 219/245
2008/0087295 A1* 4/2008 Park ..... A45D 1/02 132/232

FOREIGN PATENT DOCUMENTS

DE 102006002651 * 8/2007 ..... D06F 59/02

OTHER PUBLICATIONS

DE102006002651—Machine Translation, Aug. 2007.*

* cited by examiner

*Primary Examiner* — Marc Lorenzi

(57) ABSTRACT

A tie steaming device for steaming ties includes a housing that defines an interior space. A reservoir, a power module, a boiler and a pump are coupled to the housing and positioned in the interior space. The boiler and the pump are operationally coupled to the power module. The pump is fluidically coupled to the reservoir and the boiler. The device also comprises a shell that is hollow. The shell is fluidically couplable to the boiler. Each of a plurality of vents is positioned in the shell. The pump is positioned to transfer water from the reservoir to the boiler, such that the boiler converts the water to steam. The shell is configured for insertion into a user's tie to direct the steam through the vents to contact the tie.

14 Claims, 5 Drawing Sheets

TIE STEAMING DEVICE

BACKGROUND OF THE DISCLOSURE

Field of the Disclosure

The disclosure relates to steaming devices and more particularly pertains to a new steaming device for steaming ties.

SUMMARY OF THE DISCLOSURE

An embodiment of the disclosure meets the needs presented above by generally comprising a housing that defines an interior space. A reservoir, a power module, a boiler and a pump are coupled to the housing and positioned in the interior space. The boiler and the pump are operationally coupled to the power module. The pump is fluidically coupled to the reservoir and the boiler. The device also comprises a shell that is hollow. The shell is fluidically couplable to the boiler. Each of a plurality of vents is positioned in the shell. The pump is positioned to transfer water from the reservoir to the boiler, such that the boiler converts the water to steam. The shell is configured for insertion into a user's tie to direct the steam through the vents to contact the tie.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
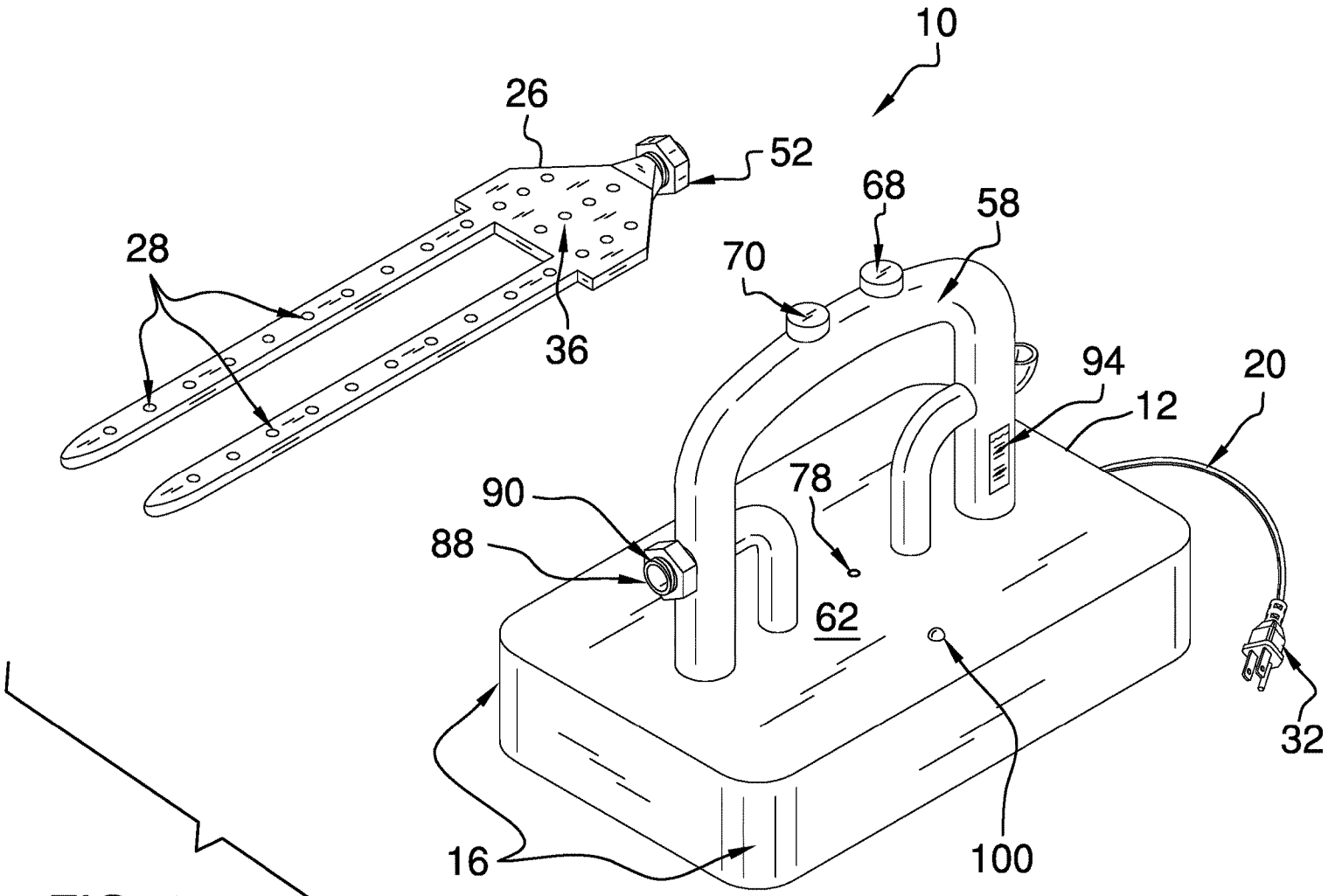
FIG. 1 is an isometric perspective view of a tie steaming device according to an embodiment of the disclosure.
Figure 2:
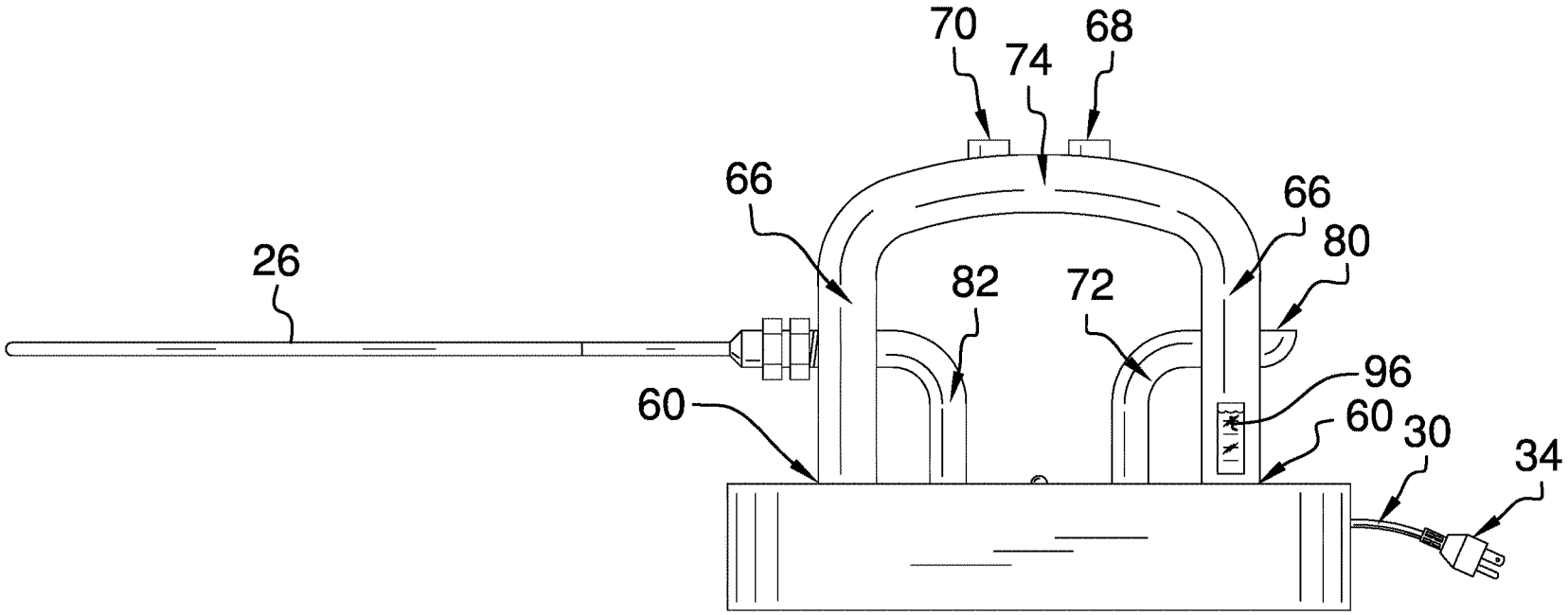
FIG. 2 is a side view of an embodiment of the disclosure.
Figure 3:
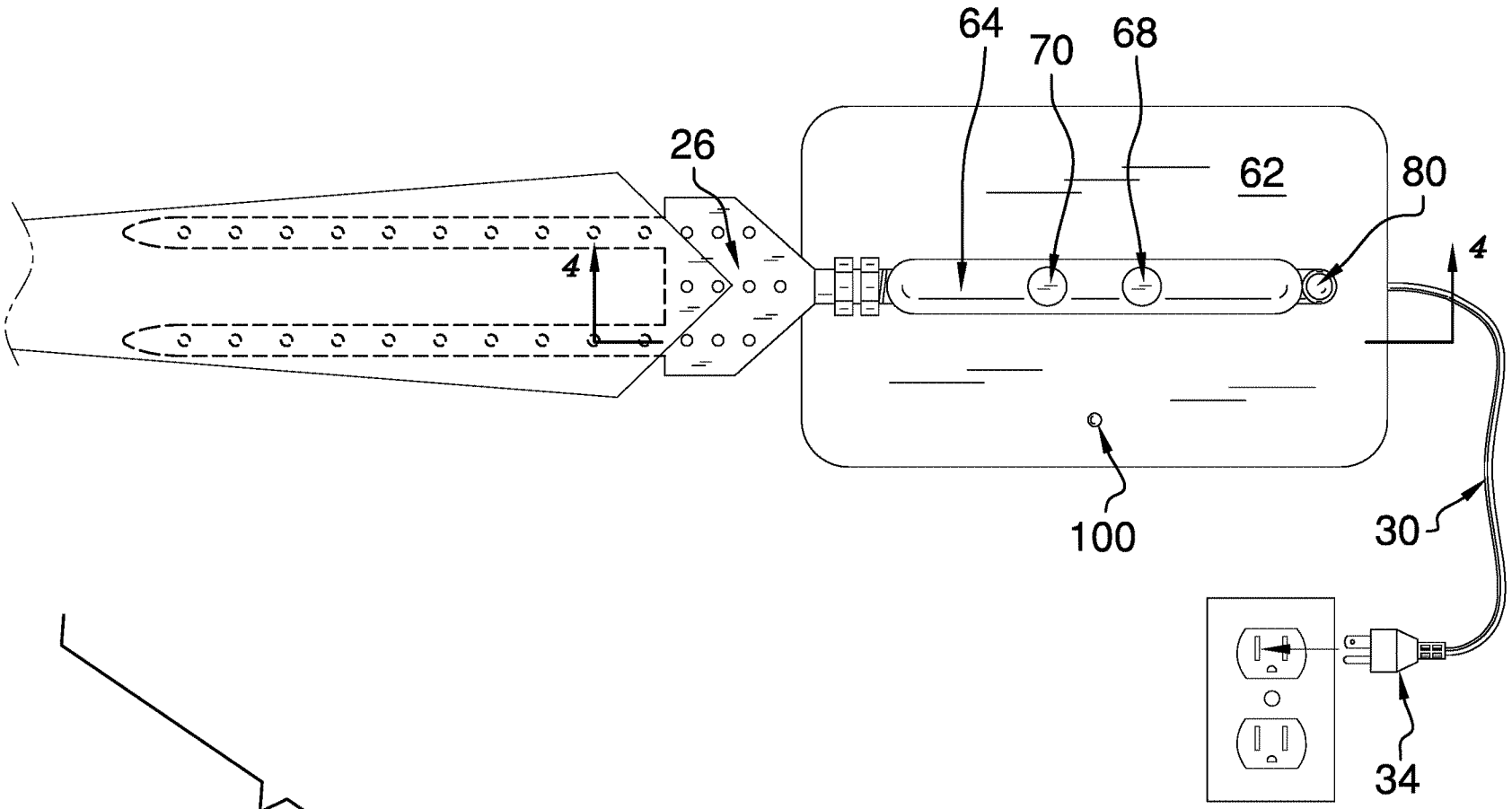
FIG. 3 is a top view of an embodiment of the disclosure.
Figure 4:
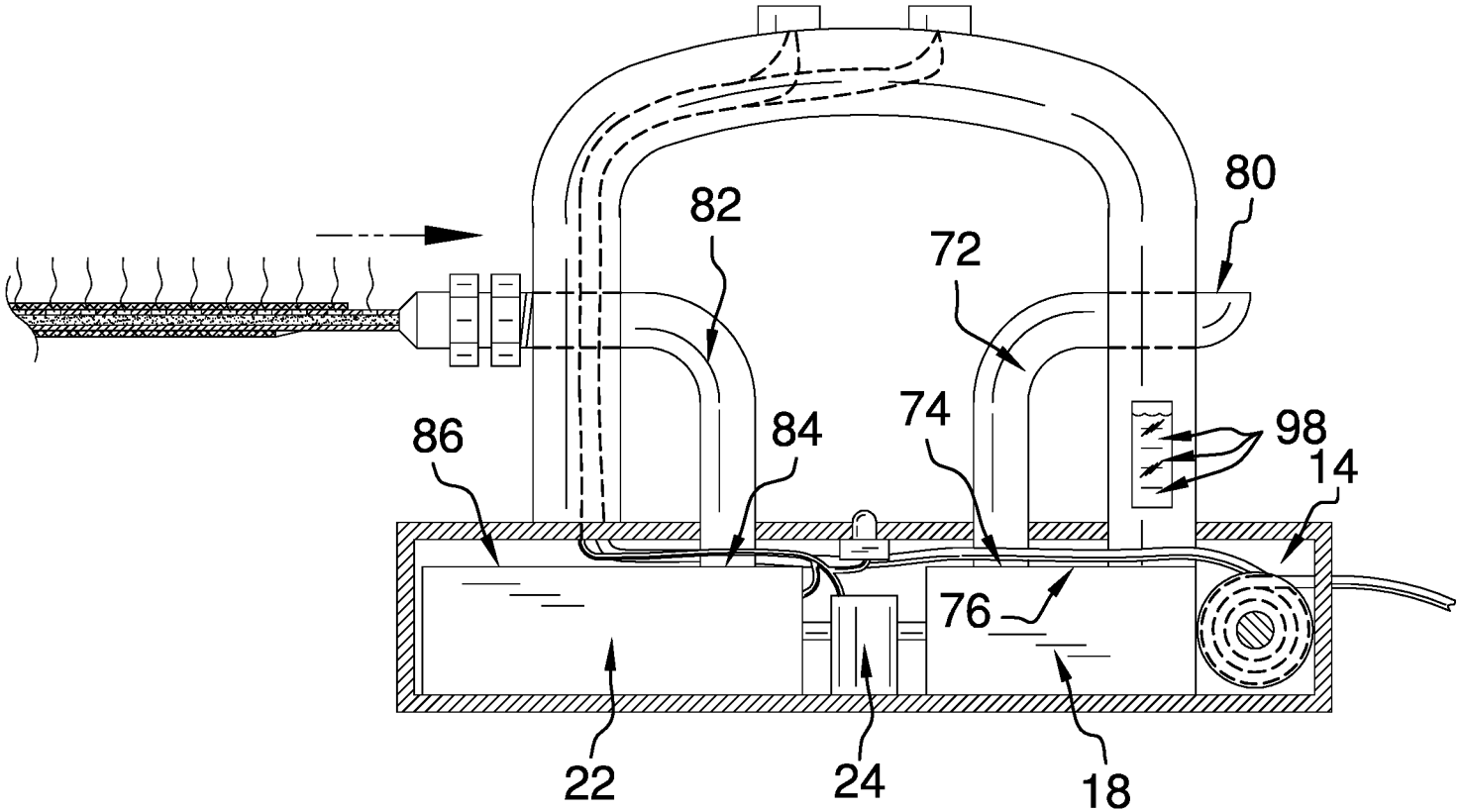
FIG. 4 is a cross-sectional view of an embodiment of the disclosure.
Figure 5:
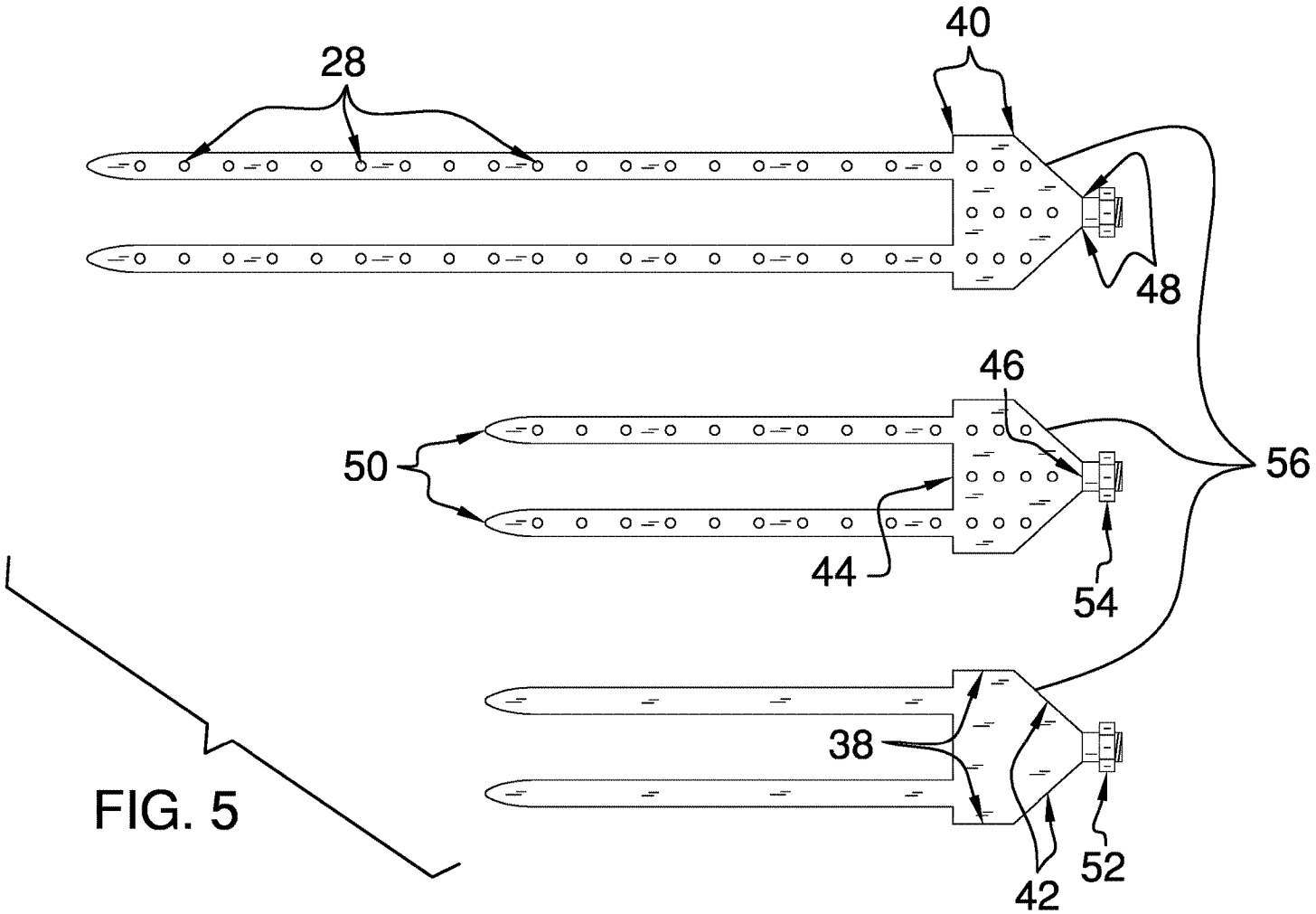
FIG. 5 is a top view of an embodiment of the disclosure.

With reference now to the drawings, and in particular to FIGS. 1 through 5 thereof, a new steaming device embodying the principles and concepts of an embodiment of the disclosure and generally designated by the reference numeral 10 will be described.

As best illustrated in FIGS. 1 through 5, the tie steaming device 10 generally comprises a housing 12 that defines an interior space 14. The housing 12 is substantially rectangularly box shaped and has rounded edges 16. A reservoir 18, a power module 20, a boiler 22 and a pump 24 are coupled to the housing 12 and positioned in the interior space 14. The boiler 22 and the pump 24 are operationally coupled to the power module 20. The pump 24 is fluidically coupled to the reservoir 18 and the boiler 22. The pump 24 is positioned to transfer water from the reservoir 18 to the boiler 22, such that the boiler 22 converts the water to steam. The device 10 also comprises a shell 26 that is hollow and fork shaped. The shell 26 is fluidically couplable to the boiler 22. Each of a plurality of vents 28 is positioned in the shell 26. The vents 28 are circular. The shell 26 is configured for insertion into a user's tie to direct the steam through the vents 28 to contact the tie.

The power module 20 comprises a power cord 30 that is extendable from and retractable into the housing 12. The power cord 30 comprises a connector 32 that is couplable to an alternating current source. The connector 32 is selected from the group of plug types consisting of plug Types A, B, C, D, E, F, G, H, I, J, K, L, M, N, and O. Preferably, the connector comprises a Type B plug 34.

The shell 26 comprises a neck 36. The neck 36 comprises a pair of opposing sides 38 each having opposing ends 40. Each of a pair of angled sides 42 extends from a respective opposing end 40. A wide end 44 extends between respective opposing ends 40 of the opposing sides 38. A narrow end 46 extends between respective termini 48 of the angled sides 42. A plurality of tines 50 is coupled to and extends from the wide end 44 of the neck 36. The neck 36 and the tines 50 are coplanar. Preferably, the plurality of tines 50 comprises two tines. A first coupler 52 is coupled to and extends from the narrow end 46 of the neck 36. Preferably, the first coupler 52 comprises a female threaded connector 54.

The shell 26 may comprise a plurality of shells 56. Each shell 56 has respective tines 50 positioned on the wide end 44 of the neck 36 such that each shell 56 is configured to insert into a tie that has a specified width.

The device 10 includes a handle 58 that has opposing termini 60, both of which are coupled to an upper surface 62 of the housing 12. The handle 58 comprises a cross piece 64 that extends between opposing arms 66. Preferably, the handle 58 is tubular.

A low set button 68 and a high set button 70 are positioned in the cross piece 64 of the handle 58. The low set button 68 and the high set button 70 are operationally coupled to the pump 24 and the boiler 22. The low set button 68 is depressible to communicate a low setting to the pump 24 and the boiler 22, such that a quantity of steam is generated. The high set button 70 is depressible to communicate a high setting to the pump 24 and the boiler 22, such that a larger quantity of steam is generated than when the low set button 68 is depressed.

A tube 72 that has a first end 74 coupled to an upper face 76 of the reservoir 18 extends through the upper surface 62 of the housing 12 substantially equally distant from a respective opposing terminus 60 of the handle 58 and a center 78 of the upper surface 62. A second end 80 of the tube 72 is configured to add water to the reservoir 18. Preferably, the tube 72 is curved 90 degrees, such that the tube 72 passes perpendicularly through a respective opposing arm 66 of the handle 58, and the second end 80 is cup shaped.

A pipe 82 that has a first terminus 84 coupled to a lid 86 of the boiler 22 extends through the upper surface 62 of the housing 12 substantially equally distant from a respective opposing terminus 60 of the handle 58 and the center 78 of the upper surface 62. A second terminus 88 of the pipe 82 is configured to couple to the shell 26. Preferably, the pipe 82 is curved 90 degrees, such that the pipe 82 passes perpendicularly through a respective opposing arm 66 of the handle 58. A second coupler 90 is coupled to the second terminus 88 of the pipe 82. The second coupler 90 is complimentary to the first coupler 52, such that the second coupler 90 is positioned to couple to the first coupler 52 to fluidically couple the shell 26 to the pipe 82. Preferably, the second coupler 90 comprises a male threaded connector 92.

An indicator 94 is positioned in the handle 58. The indicator 94 is operationally coupled to the reservoir 18. The indicator 94 is configured to respond to the level of water in the reservoir 18 such that the user is notified of the water level. Preferably, the indicator 94 comprises a window 96 that is positioned in a respective opposing arm 66 of the handle 58. The window 96 has horizontal level lines 98.

A light 100 is coupled to the housing 12. The light 100 is operationally coupled to the power module 20 and positioned through the upper surface 62 of the housing 12. The light 100 is illuminated when power is flowing from the power module 20.

In use, the pump 24 is positioned to transfer water from the reservoir 18 to the boiler 22. The boiler 22 converts the water to steam. The shell 26 is configured to insert into a user's tie, such that the shell 26 is positioned to direct the steam through the vents 28 to contact the tie.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A tie steaming device comprising:

a housing, said housing defining an interior space;

a reservoir, said reservoir being coupled to said housing and positioned in said interior space;

a power module, said power module being coupled to said housing and positioned in said interior space;

a boiler, said boiler being coupled to said housing and positioned in said interior space, said boiler being operationally coupled to said power module;

a pump, said pump being coupled to said housing and positioned in said interior space, said pump being operationally coupled to said power module, said pump being fluidically coupled to said reservoir and said boiler;

a shell, said shell being hollow, said shell being fluidically couplable to said boiler, said shell being fork shaped, said shell comprising a neck, said neck comprising:

a pair of opposing sides, a pair of angled sides, each said angled side extending from a respective opposing end of each said opposing side, a wide end, said wide end extending between respective opposing ends of said opposing sides, a narrow end, said narrow end extending between respective termini of said angled sides, a plurality of tines, said tines being coupled to and extending from said wide end of said neck, said neck and said tines being coplanar, and a first coupler, said first coupler being coupled to and extending from said narrow end of said neck;

a plurality of vents, each said vent being positioned in said shell;

wherein said pump is positioned to transfer water from said reservoir to said boiler, wherein said boiler converts the water to steam, and wherein said shell is configured for insertion into a user's tie, such that said shell is positioned to direct the steam through said vents to contact the tie;

a handle, said handle having opposing termini, each said opposing terminus being coupled to an upper surface of said housing, said handle comprising opposing arms and a cross piece extending between said opposing arms, said handle being tubular;

a tube, said tube having a first end coupled to an upper face of said reservoir, said tube extending through said upper surface of said housing equally distant from a respective one of the said opposing terminus of said handle and a center of said upper surface, such that a second end of said tube is configured for addition of water to said reservoir, said tube being curved 90 degrees, such that said tube passes perpendicularly through a respective one of said opposing arms of said handle, said second end being cup shaped; and a pipe, said pipe having a first terminus coupled to a lid of said boiler, said pipe extending through said upper surface of said housing equally distant from another respective one of the said opposing terminus of said handle and said center of said upper surface, such that a second terminus of said pipe is configured for coupling to said shell, said pipe being curved 90 degrees, such that said pipe passes perpendicularly through another respective one of said opposing arms of said handle.

2. The tie steaming device of claim 1, further including said plurality of tines comprising only two tines.

3. The tie steaming device of claim 1, further including said shell being one of a plurality of shells, wherein each said shell has respective said tines positioned on said wide end such that each said shell is configured for insertion into a tie having a specified width.

4. The tie steaming device of claim 1, further including said vents being circular.

5. The tie steaming device of claim 1, further comprising:

a low set button, said low set button being positioned in said cross piece of said handle, said low set button being operationally coupled to said pump and said boiler;

a high set button, said high set button being positioned in said cross piece of said handle, said high set button being operationally coupled to said pump and said boiler; and wherein said low set button is depressible to communicate a low setting to said pump and said boiler, such that a quantity of steam is generated, and wherein said high set button is depressible to communicate a high setting to said pump and said boiler, such that a larger quantity of steam is generated than when said low set button is depressed.

6. The tie steaming device of claim 1, further including a second coupler, said second coupler being coupled to said second terminus of said pipe, said second coupler being complimentary to said first coupler, wherein said second coupler is positioned to couple to said first coupler to fluidically couple said shell to said pipe.

7. The tie steaming device of claim 6, further comprising:

said second coupler comprising a male threaded connector; and said first coupler comprising a female threaded connector.

8. The tie steaming device of claim 1, further including an indicator, said indicator being positioned in said handle, said indicator being operationally coupled to said reservoir, wherein said indicator is configured to respond to the level of water in said reservoir such that the user is notified of the water level.

9. The tie steaming device of claim 8, further including said indicator comprising a window positioned in a respective opposing arm of said handle, said window having horizontal level lines.

10. The tie steaming device of claim 1, further including a light, said light being coupled to said housing, said light being operationally coupled to said power module, said light being positioned through said upper surface of said housing, wherein said light is illuminated when power is flowing from said power module.

11. The tie steaming device of claim 1, further comprising:

said housing being rectangularly box shaped; and said housing having rounded edges.

12. The tie steaming device of claim 1, further comprising:

said power module comprising a power cord;

said power cord being extendable from and retractable into said housing; and said power cord comprising a connector, said connector being couplable to an alternating current source, said connector being selected from the group of plug types consisting of plug Types A, B, C, D, E, F, G, H, I, J, K, L, M, N, and O.

13. The tie steaming device of claim 12, further including said connector comprising a Type B plug.

14. A tie steaming device comprising:

a housing, said housing defining an interior space, said housing being rectangularly box shaped, said housing having rounded edges;

a reservoir, said reservoir being coupled to said housing and positioned in said interior space;

a power module, said power module being coupled to said housing and positioned in said interior space, said power module comprising a power cord, said power cord being extendable from and retractable into said housing, said power cord comprising a connector, said connector being couplable to an alternating current source, said connector comprising a Type B plug;

a boiler, said boiler being coupled to said housing and positioned in said interior space, said boiler being operationally coupled to said power module;

a pump, said pump being coupled to said housing and positioned in said interior space, said pump being operationally coupled to said power module, said pump being fluidically coupled to said reservoir and said boiler;

a shell, said shell being hollow, said shell being fluidically couplable to said boiler, said shell being fork shaped, said shell comprising:

a neck, said neck comprising:

a pair of opposing sides, a pair of angled sides, each said angled side extending from a respective opposing end of each said opposing side, a wide end, said wide end extending between respective opposing ends of said opposing sides, and a narrow end, said narrow end extending between respective termini of said angled sides, a plurality of tines, said tines being coupled to and extending from said wide end of said neck, said neck and said tines being coplanar, said plurality of tines comprising two tines; and a first coupler, said first coupler being coupled to and extending from said narrow end of said neck, said first coupler comprising a female threaded connector;

said shell being one of a plurality of shells, wherein each said shell has respective said tines positioned on said wide end such that each said shell is configured for insertion into a tie having a specified width;

a plurality of vents, each said vent being positioned in said shell, said vents being circular;

a handle, said handle having opposing termini, each said opposing terminus being coupled to an upper surface of said housing, said handle comprising opposing arms and a cross piece extending between said opposing arms, said handle being tubular;

a low set button, said low set button being positioned in said cross piece of said handle, said low set button being operationally coupled to said pump and said boiler, wherein said low set button is depressible to communicate a low setting to said pump and said boiler, such that a quantity of steam is generated;

a high set button, said high set button being positioned in said cross piece of said handle, said high set button being operationally coupled to said pump and said boiler, wherein said high set button is depressible to communicate a high setting to said pump and said boiler, such that a larger quantity of steam is generated than when said low set button is depressed;

a tube, said tube having a first end coupled to an upper face of said reservoir, said tube extending through said upper surface of said housing equally distant from a respective one of the said opposing terminus of said handle and a center of said upper surface, such that a second end of said tube is configured for addition of water to said reservoir, said tube being curved 90 degrees, such that said tube passes perpendicularly through a respective one of said opposing arms of said handle, said second end being cup shaped;

a pipe, said pipe having a first terminus coupled to a lid of said boiler, said pipe extending through upper surface of said housing substantially equally distant from said another respective one of the said opposing terminus of said handle and said center of said upper surface, such that a second terminus of said pipe is configured for coupling to said shell, said pipe being curved 90 degrees, such that said pipe passes perpendicularly through another respective one of said opposing arms of said handle;

a second coupler, said second coupler being coupled to said second terminus of said pipe, said second coupler being complimentary to said first coupler, wherein said second coupler is positioned to couple to said first coupler to fluidically couple said shell to said pipe, said second coupler comprising a male threaded connector;

an indicator, said indicator being positioned in said handle, said indicator being operationally coupled to said reservoir, wherein said indicator is configured to respond to the level of water in said reservoir such that the user is notified of the water level, said indicator comprising a window positioned in a respective opposing arm of said handle, said window having horizontal level lines;

a light, said light being coupled to said housing, said light being operationally coupled to said power module, said light being positioned through said upper surface of said housing, wherein said light is illuminated when power is flowing from said power module; and wherein said pump is positioned to transfer water from said reservoir to said boiler, wherein said boiler converts the water to steam, and wherein said shell is configured for insertion into a user's tie, such that said shell is positioned to direct the steam through said vents to contact the tie.

* * * * *